US009028104B2

(12) United States Patent
Lee et al.

(10) Patent No.: US 9,028,104 B2
(45) Date of Patent: May 12, 2015

(54) LED PROJECTION LAMP

(71) Applicant: Zhongshan Weiqiang Technology Co., Ltd., Zhongshan City, Guangdong (CN)

(72) Inventors: Ke-Chin Lee, Zhongshan (CN); Hung-Chieh Chen, Zhongshan (CN)

(73) Assignee: Zhongshan Weiqiang Technology Co., Ltd., Zhongshan, Guangdong (CN)

( * ) Notice: Subject to any disclaimer, the term of this patent is extended or adjusted under 35 U.S.C. 154(b) by 190 days.

(21) Appl. No.: 13/632,193

(22) Filed: Oct. 1, 2012

(65) Prior Publication Data

US 2013/0229799 A1 Sep. 5, 2013

(30) Foreign Application Priority Data

Mar. 2, 2012 (CN) ..... 2012 1 0052973

(51) Int. Cl.
*F21V 15/06* (2006.01)
*F21V 29/00* (2006.01)
*F21Y 101/02* (2006.01)

(52) U.S. Cl.
CPC ..... *F21V 29/006* (2013.01); *F21V 29/74* (2015.01); *F21Y 2101/02* (2013.01)

(58) Field of Classification Search
CPC .... F21V 29/22; F21V 29/004; F21V 29/2293
USPC ..... 362/235, 249.01–249.02, 296.01, 362/311.01–311.02, 341, 373, 294, 547
See application file for complete search history.

(56) References Cited

U.S. PATENT DOCUMENTS

| | | | | |
|---|---|---|---|---|
| 7,568,817 | B2 * | 8/2009 | Lee et al. | 362/294 |
| 8,459,846 | B2 * | 6/2013 | Tsao | 362/373 |
| 8,476,813 | B2 * | 7/2013 | Kong | 313/46 |
| 2008/0007954 | A1 * | 1/2008 | Li | 362/294 |
| 2008/0062694 | A1 * | 3/2008 | Lai et al. | 362/294 |
| 2009/0296411 | A1 * | 12/2009 | Chang et al. | 362/373 |
| 2013/0223063 | A1 * | 8/2013 | LEE et al. | 362/235 |

* cited by examiner

*Primary Examiner* — David V Bruce
*Assistant Examiner* — Gerald J Sufleta, II
(74) *Attorney, Agent, or Firm* — Jackson IPG PLLC; Demian K. Jackson

(57) ABSTRACT

The invention discloses an LED projection lamp, which comprises a heat sink, a lamp cup, an LED module, a lens, a first heat conduction component, a fastening device and a second heat conduction component, wherein the heat sink is cylindrical and provided with a trumpet-shaped inner cavity on the front and a cylindrical inner cavity at the rear; the lamp cup is arranged inside the trumpet-shaped inner cavity; the LED module is disposed on a small opening portion of the lamp cup; the lens is used by the LED module for light transmission; the first heat conduction component comprises a plurality of U-shaped first heat pipes; the fastening device is sleeved at the rear end of the cylindrical inner cavity; the second heat conduction component comprises a plurality of U-shaped second heat pipes.

15 Claims, 8 Drawing Sheets

LED PROJECTION LAMP

FIELD OF THE INVENTION

The invention relates to a projection lamp, in particular to an LED projection lamp.

BACKGROUND OF THE INVENTION

LED projection lamps are also known as linear LED projection lamps and the like. As the LED projection lamps take the shape of strips, they are also known as LED line lamps. The LED projection lamps are mainly applied to field lighting and architectural decorative lighting and used for drawing the outlines of buildings and fields. As the LED projection lamps are widely used, the illumination direction of the LED projection lamps is required to be relatively flexible and often required to be adjusted according to field or real-time demands. If the LED projection lamps illuminate in different directions, the transmission path of the heat produced by the LED projection lamps will be certainly affected. More severely, the heat cannot be effectively dispersed in some directions and then excessive heat is accumulated. Therefore, the use reliability and the service life of the LED projection lamps may be affected. The heat dissipation capability of LED lamps is closely interrelated to stable operation, good quality and long service life of the LED lamps. As for LED projection lamps with high brightness requirement, as the heat produced is abundant and the illumination environment is inconstant, the heat dissipation performance of the LED projection lamps is even more crucial. Therefore, when the LED projection lamps illuminate at different angles and in different directions, how to realize optimal heat dissipation, how to not affect the heat dissipation performance in the illumination direction and how to realize uniform heat dissipation at any angle are technical problems necessary to be solved.

SUMMARY OF THE INVENTION

The technical problem to be solved by the invention is to provide an LED projection lamp which has good heat dissipation performance and can realize effective heat dissipation at different angles.

The technical proposal adopted by the invention to solve the technical problem is that:

The invention relates to an LED projection lamp, which comprises:

a heat sink, in which the heat sink is cylindrical; a heat dissipation structure is arranged on the cylindrical periphery of the heat sink; and a trumpet-shaped inner cavity gradually expanded from inside to outside is formed at the front end of a cylindrical inner cavity of the heat sink;

a lamp cup, in which the lamp cup takes the shape of a trumpet which is matched with the trumpet-shaped inner cavity of the heat sink and has a large opening portion and a small opening portion; the large opening portion is clamped on the outer edge at the front end of the heat sink; and the small opening portion is disposed in the inner cavity of the heat sink;

an LED module, in which the LED module is formed by a plurality of LED chips packaged on an aluminum nitride ceramic wafer and disposed on the small opening portion of the lamp cup;

a lens, in which the lens is used by the LED module for light transmission and fixed at the front end of the heat sink through a retainer ring;

a first heat conduction component, comprising a plurality of first heat pipes which are bent in the shape of a U, in which U-shaped central sections of a plurality of the first heat pipes are mutually pieced together to form a smoothing surface for supporting and fixing the LED module; and U-shaped ends of a plurality of the first heat pipes are sleeved outside the lamp cup and adhered to the wall of the trumpet-shaped inner cavity of the heat sink;

a fastening device, in which the fastening device is cylindrical and sleeved at the rear end of the cylindrical inner cavity of the heat sink;

a second heat conduction component, comprising a plurality of second heat pipes which are bent in the shape of a U, in which U-shaped central sections of a plurality of the second heat pipes are mutually pieced together and make contact with the U-shaped central sections of the first heat pipes; and U-shaped ends of a plurality of the second heat pipes are sleeved outside the fastening device and adhered to the wall of the cylindrical inner cavity of the heat sink; and a mounting plate, in which the mounting plate is disposed at the rear of the smoothing surface of a plurality of the first heat pipes and used for supporting and fixing the U-shaped central sections of the first and second heat pipes; wherein the total radiating power of the first and second heat conduction components is more than or equal to the power produced by the LED module; and the heat conduction path is as follows: the heat is directly conducted from the LED chips to the aluminum nitride ceramic wafer first, then directly conducted to the first and second heat conduction components, finally conducted to heat pipes, an inner radiator and an outer radiator, and dispersed by fin devices of the radiators via cross-ventilation and radiation, in which the aluminum nitride ceramic wafer and the heat pipes are all heat conducting media with low thermal resistance.

As a further improvement of the proposal, the first heat conduction component also comprises at least one third transverse heat pipe which is bent and surrounds the periphery of the lamp cup; a third groove for receiving the third transverse heat pipe is formed on the outerwall of the lamp cup and takes the shape of a circular arc; one side of the third transverse heat pipe, adhered to the third groove, is a cambered surface correspondingly; and the outside of the third transverse heat pipe makes contact with the wall of the trumpet-shaped inner cavity of the heat sink and the insides of the U-shaped ends of the first heat pipes.

As a further improvement of the proposal, the second heat conduction component also comprises at least one fourth transverse heat pipe which is bent and surrounds the periphery of the fastening device; a fourth groove for receiving the fourth transverse heat pipe is formed on the outerwall of the fastening device; and the outside of the fourth transverse heat pipe makes contact with the wall of the cylindrical inner cavity of the heat sink and the insides of the U-shaped ends of the second heat pipes.

As a further improvement of the proposal, a plurality of first grooves are formed along the axial direction of the wall of the trumpet-shaped inner cavity of the heat sink; the U-shaped ends of the first heat pipes are matched with and tightly adhered to the insides of the first grooves, so that the aim of uniform heat dissipation can be achieved; the first grooves take the shape of circular arcs; and one sides of the first heat pipes, adhered to the first grooves, are cambered surfaces correspondingly.

As a further improvement of the proposal, a plurality of second grooves are formed along the axial direction of the wall of the cylindrical inner cavity of the heat sink; the U-shaped ends of the second heat pipes are matched with and tightly adhered to the insides of the second grooves, so that the aim of uniform heat dissipation can be achieved; the second grooves take the shape of circular arcs; and one sides of the second heat pipes, adhered to the second grooves, are cambered surfaces correspondingly.

As a further improvement of the proposal, the mounting plate is disposed between the U-shaped central sections of the first heat pipes and the U-shaped central sections of the second heat pipes; a first clamping thread of which the shape is matched with that of the U-shaped central sections of the first heat pipes is formed on the front of the mounting plate and used for clamping the U-shaped central sections of the first heat pipes; a second clamping thread of which the shape is matched with that of the U-shaped central sections of the second heat pipes is formed at the rear of the mounting plate and used for clamping the U-shaped central sections of the second heat pipes; and a hole is formed between the first clamping thread and the second clamping thread, so that the clamped U-shaped central sections of the first heat pipes can make vertical contact with the clamped U-shaped central sections of the second heat pipes in the up-and-down direction, and thus optimal heat conduction condition can be achieved.

In addition, a second mounting plate is also arranged at the rear of the U-shaped central sections of the second heat pipes and provided with a clamping thread for clamping the U-shaped central sections of the second heat pipes, so that the U-shaped central sections of the second heat pipes can be supported and fixed by the second mounting plate.

Moreover, an outward flange is formed on the outer edge at the front end of the heat sink; and the retainer ring is clamped on the outward flange.

Furthermore, the lens is a Fresnel lens.

Still further, a light-transmitting mirror for covering the lens is clamped on the retainer ring.

The LED projection lamp has the advantages that: as the LED projection lamp adopts the heat conduction components comprising the heat pipes to conduct heat for the LED module and the heat conduction components can realize high-efficiency heat exchange via internal working media, the heat of the LED module can be quickly conducted to the heat sink, the lamp cup and the fastening device and then effectively dispersed in time, and thus good radiating effect can be achieved.

As the heat conduction components comprising the heat pipes realize quick heat conduction through the working media and have directivity during the operation, the heat conduction performance of the heat conduction components may be affected when the LED projection lamp illuminates in different directions. In order to solve the problem, the LED projection lamp adopts two heat conduction components, namely the first heat conduction component and the second heat conduction component which are respectively disposed on the front and at the rear of a heat source, namely the LED module. Therefore, when the LED projection lamp illuminates upwards, the first heat conduction component has optimal heat dissipation efficiency and has the function of primary heat dissipation. When the LED projection illuminates downwards, the second heat conduction component has optimal heat dissipation efficiency and has the function of primary heat dissipation. Obviously, due to the interaction between the first and second heat conduction components, the heat conduction efficiency of the LED projection lamp can be always maintained to be high enough, and thus the LED projection lamp can have good heat dissipation efficiency when illuminating in any direction.

BRIEF DESCRIPTION OF THE DRAWINGS

In order to more clearly illustrate the technical proposals of the embodiments of the invention, brief description is given to the attached drawings required to be used in the illustration of the embodiments. Obviously, the attached drawings illustrated are only one part of embodiments of the invention and not all the embodiments. Those skilled in the art can also obtain other design proposals and attached drawings on the basis of the attached drawings on the premise of not offering creative work.

DETAILED DESCRIPTION OF THE PREFERRED EMBODIMENTS

Clear and complete description is given to the concept, specific structure and technical effects achieved of the invention with the attached embodiments and drawings, so that those skilled in the art can fully understand the objectives, characteristics and advantages of the invention. Obviously, the embodiments illustrated are only one part of embodiments of the invention and not all the embodiments. Other embodiments obtained by those skilled in the art on the basis of the embodiments of the invention on the premise of not offering creative work shall be all within the scope of protection of the invention.

Figure 1:
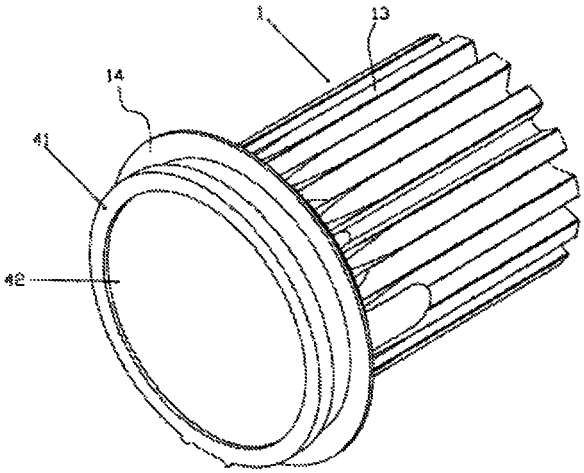
FIG. 1 is a stereogram of the LED projection lamp provided by the invention.
Figure 2:
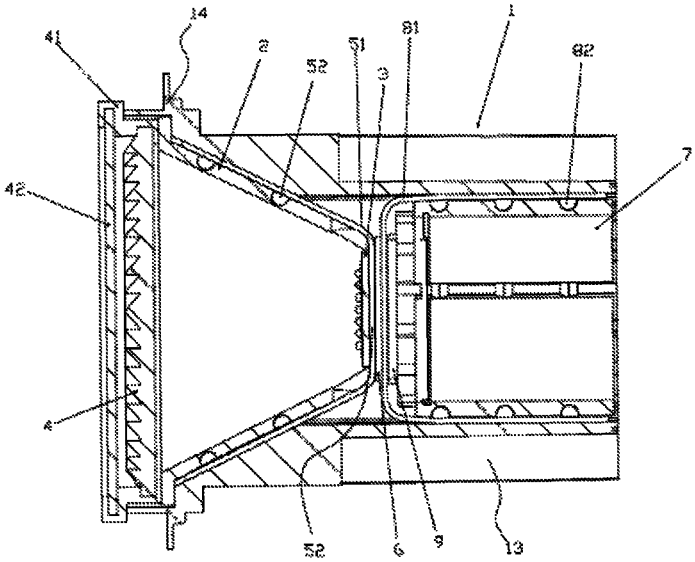
FIG. 2 is a section view of the LED projection lamp provided by the invention.
Figure 3:
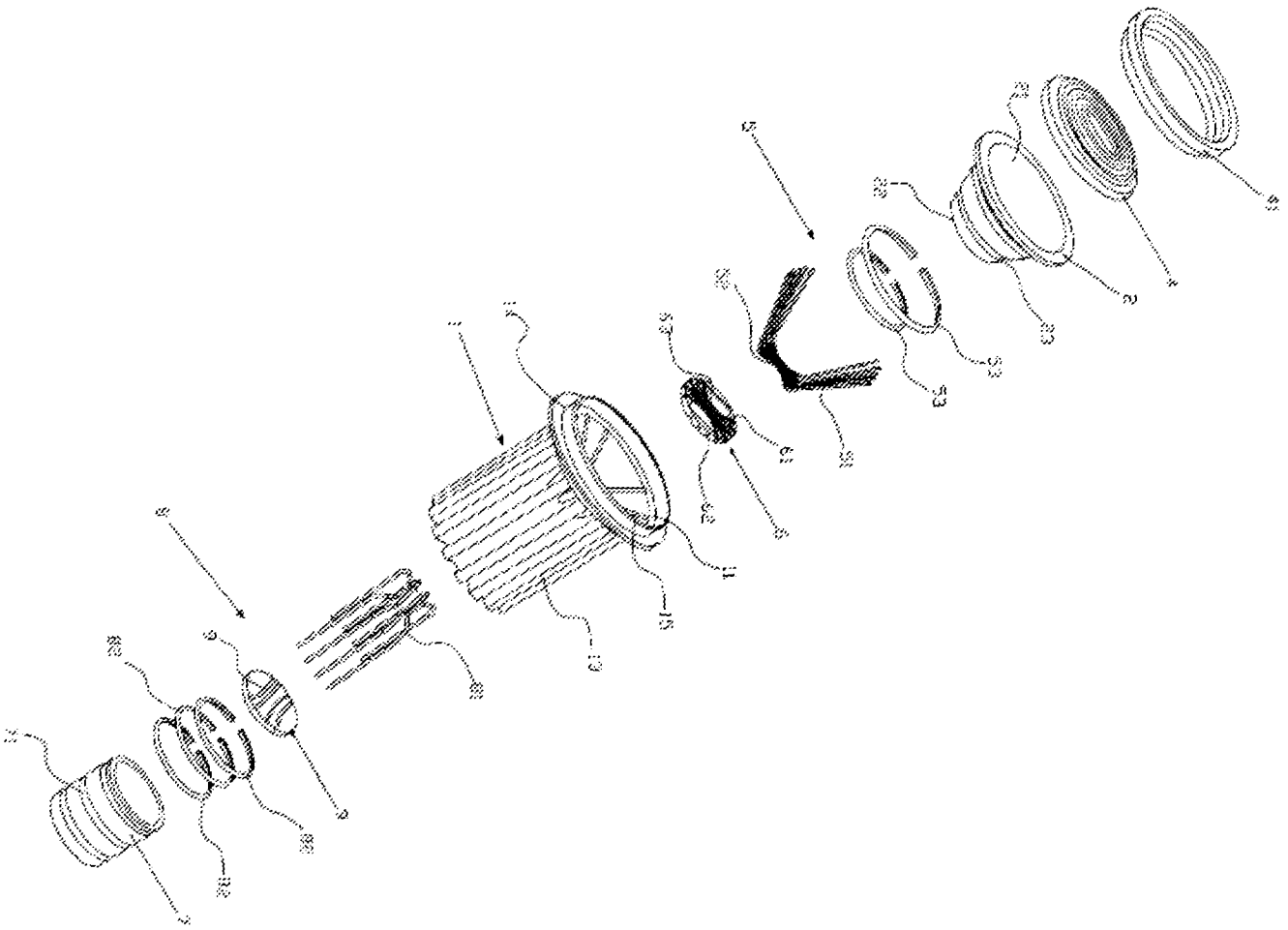
FIG. 3 is an exploded view of the LED projection lamp provided by the invention.

As illustrated in FIGS. 1 to 3, the LED projection lamp provided by the invention mainly comprises a heat sink 1, a lamp cup 2, an LED module 3, a lens 4, a first heat conduction component 5, a mounting plate 6, a fastening device 7 and a second heat conduction component 8.

Figure 4:
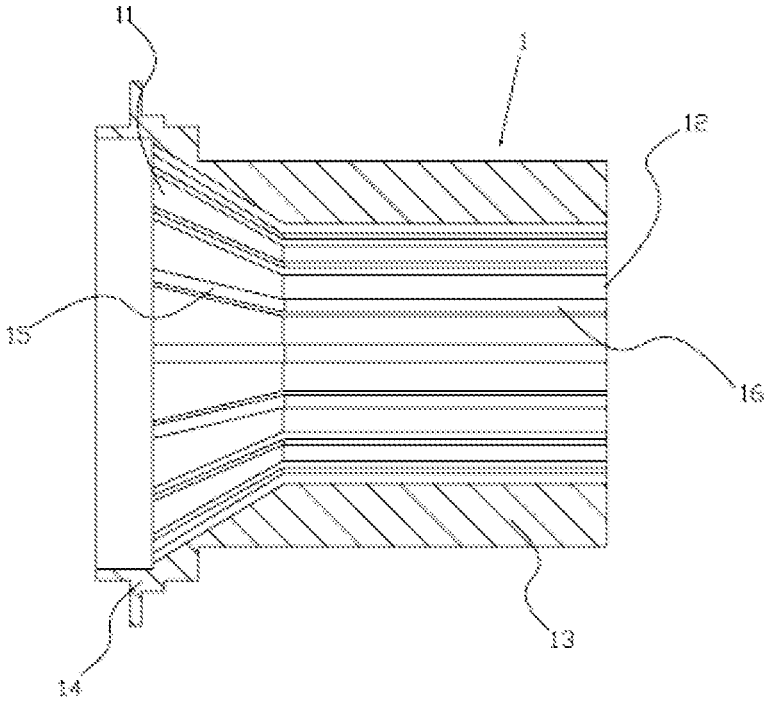
FIG. 4 is a section view of a heat sink of the LED projection lamp provided by the invention.

Wherein, the heat sink 1 is cylindrical. As illustrated in FIG. 4, the heat sink 1 has a cylindrical inner cavity 12; a heat dissipation structure 13 is arranged on the cylindrical periphery of the heat sink, can be a radiating fin or a heat dissipation channel capable of producing stack effect, and most frequently can be extended along the axial direction of the cylindrical periphery; a trumpet-shaped inner cavity 11 gradually expanded from inside to outside is formed at the front end of the cylindrical inner cavity 12 of the heat sink 1; a large opening of the trumpet-shaped inner cavity 11 is disposed outwards and a small opening of the trumpet-shaped inner cavity 11 is disposed inwards; and the trumpet-shaped inner cavity 11 is combined with the cylindrical inner cavity 12.

Figure 5:
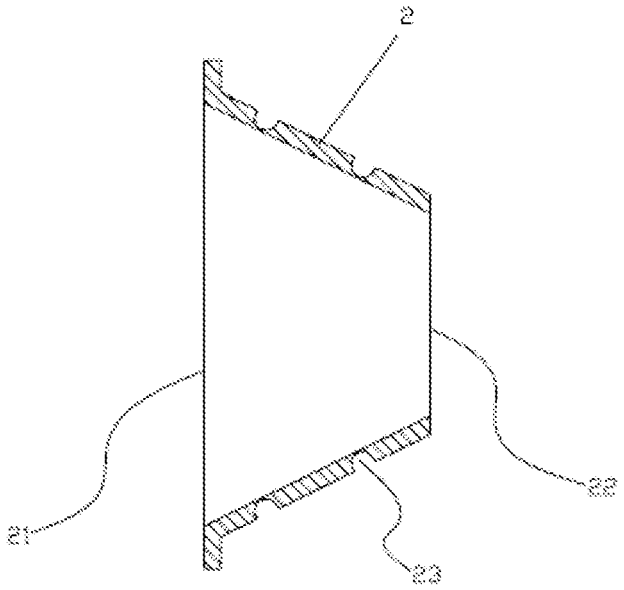
FIG. 5 is a section view of a lamp cup of the LED projection lamp provided by the invention.

Wherein, the lamp cup 2 takes the shape of a trumpet which is matched with the trumpet-shaped inner cavity 11 of the heat sink 1. As illustrated in FIG. 5, the lamp cup 2 has a large opening portion 21 and a small opening portion 22, wherein the large opening portion 21 is clamped on the outer edge at the front end of the heat sink 1 and just covers the trumpet-shaped large opening of the heat sink 1; and the small opening portion 22 is disposed in the cylindrical inner cavity 12 of the heat sink 1 and can be extended to the trumpet-shaped small opening of the heat sink 1 and cover the trumpet-shaped small opening of the heat sink 1.

Wherein, the LED module 3 is disposed in the cylindrical inner cavity 12 of the heat sink 1, formed by a plurality of LED chips packaged on an aluminum nitride ceramic wafer, and positioned on the small opening portion 22 of the lamp cup 2. The light-emitting direction of the LED module 3 is towards the large opening portion 21 of the lamp cup 2, so that the light emitted can be emitted from the lamp cup 2 and the lamp cup 2 also has the function of reflecting condensation.

Wherein, the lens 4 is used by the LED module 3 for light transmission and fixed at the front end of the heat sink 1 through a retainer ring 41 and covers the large opening of the heat sink 1 and the large opening portion 21 of the lamp cup 2, so that the light emitted by the LED module 3 can pass through the lens 4 together and then be emitted, and thus the lens 4 has the function of light concentration. For the convenience of clamping the lens 4 and leaving space for a clamping and matching structure for the outside, an outward flange 14 can be formed on the outer edge at the front end of the heat sink 1, and the retainer ring 41 is clamped on the outward flange 14 and tightly locks the lens 4. The lens 4 of the LED projection lamp provided by the invention is preferably a Fresnel lens of which one side is a smooth surface and the other side is provided with concentric circles from small to large by engraving. The whole lens is relatively thin, so the assembly of other structures of the projection lamp may not be affected. Moreover, the lens can also have the functions of good light transmission and focusing. Therefore, the lens is applicable to the projection lamp. Of course, the lens 4 can also adopt an optical lens such as a convex lens and a concave lens. In the case that the Fresnel lens is adopted, in order to protect the lens and the internal structure and realize the sealing, water resistance and dust prevention, a light-transmitting mirror 42 for covering the lens 4 can be also clamped on the retainer ring 41. Herein, it is equivalent that the light-transmitting mirror 42 is disposed on the outmost layer and can be directly seen by people, the lens 4 disposed on the inside and the LED module 3 disposed on the innermost side. In an actual structure, a circle of annular clamping grooves can be formed in the retainer ring 41 and used for clamping the light-transmitting mirror 42.

The LED module 3 may produce heat in the working process. In the optimal situation, the heat must be transmitted to the heat sink 1 in time and dispersed in time through the heat dissipation structure 13 of the heat sink 1. In order to be close to the optimal situation as much as possible, the LED projection lamp provided by the invention adopts the first heat conduction component 5 and the second heat conduction component 8.

Figure 6:
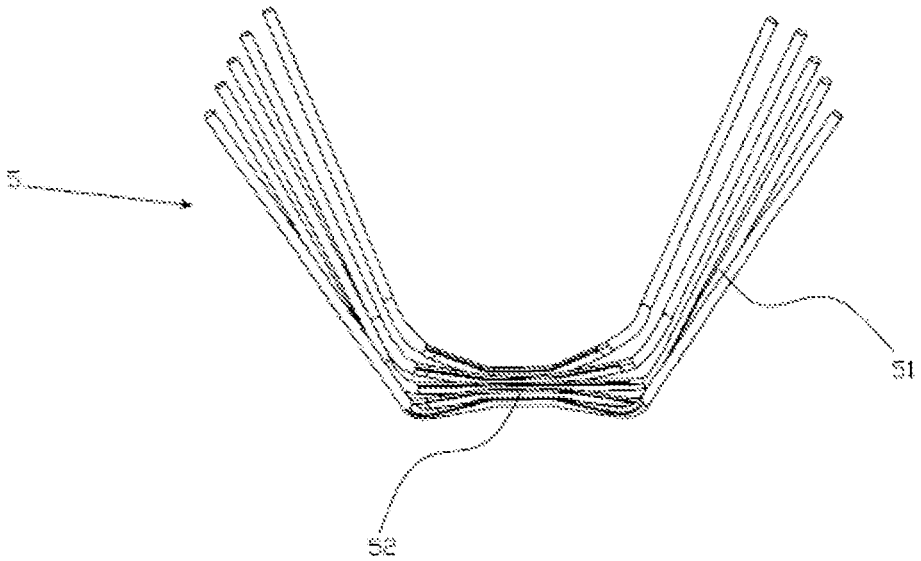
FIG. 6 is a structure diagram of a plurality of first heat pipes of the LED projection lamp provided by the invention.

As illustrated in FIG. 6, the first heat conduction component 5 mainly comprises a plurality of first heat pipes 51 which are all bent in the shape of a U, so that each first heat pipe 51 has a U-shaped central section and two U-shaped ends. Of course, one U-shaped first heat pipe 51 can be formed by bending a single heat pipe and can also be formed by piecing two L-shaped heat pipes together. The U-shaped central sections of a plurality of the first heat pipes 51 are mutually pieced together to form a smoothing surface 52 which is used for supporting and fixing the LED module 3 and so as to makes good contact with the LED module 3, and thus the heat can be quickly transmitted. Relative to the smoothing surface 52 formed by the U-shaped central sections, the U-shaped ends of a plurality of the first heat pipes 51 are disposed on the same side with the smoothing surface 52 and spread out in the shape of a trumpet, so as to be matched with the lamp cup 2 and the trumpet-shaped inner cavity 11 of the heat sink 1 in shape. In a mounting and matching structure, the U-shaped ends of a plurality of the first heat pipes 51 are sleeved outside the lamp cup 2 and adhered to the wall of the trumpet-shaped inner cavity 11 of the heat sink 1. Therefore, the heat produced by the LED module 3 during the operation can be quickly transmitted to various U-shaped ends via the smoothing surface 52 formed by the first heat pipes 51, quickly transmitted to the trumpet-shaped inner cavity 11 of the heat sink 1 and the lamp cup 2 via the U-shaped ends, and dispersed by the heat sink 1 and the lamp cup 2.

Figure 8:
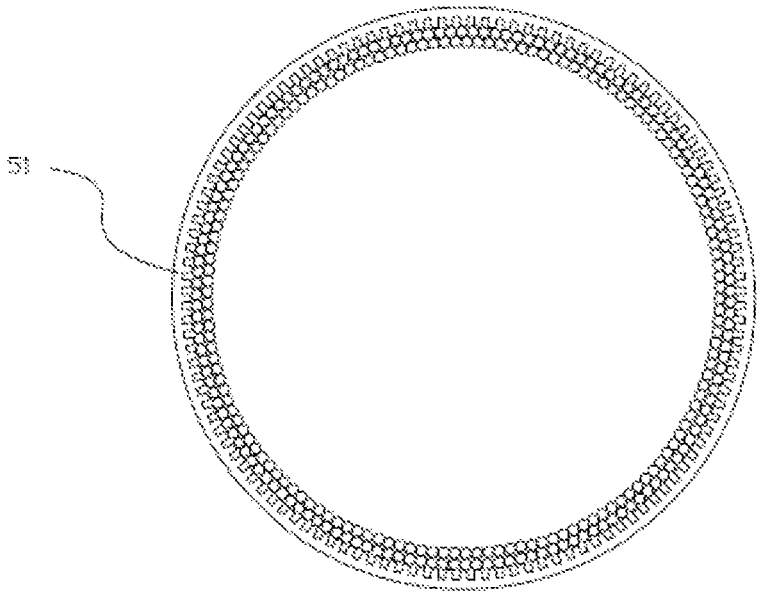
FIG. 8 is a section view of a U-shaped end for the first heat pipe of the LED projection lamp provided by the invention.
Figure 9:
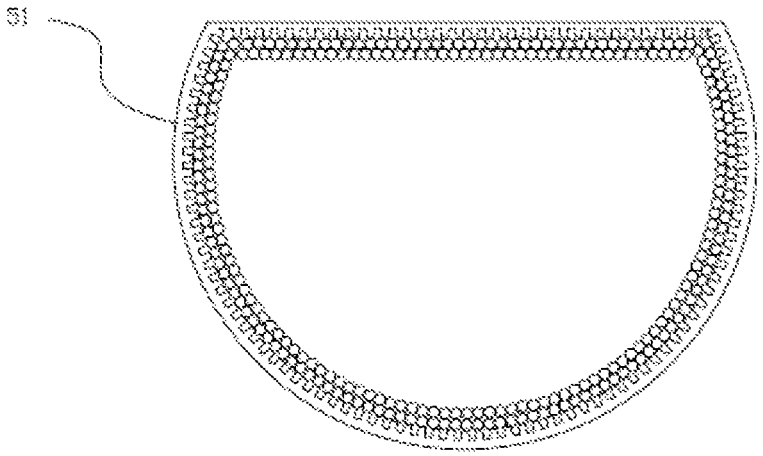
FIG. 9 is a section view of a U-shaped central section for the first heat pipe of the LED projection lamp provided by the invention.

As illustrated in FIG. 8, the heat pipes are heat conduction elements having slots and sintered capillary structures and achieve the heat transmission effect through the gas-liquid two-phase change of internal working solutions and the capillary force. The basic structure of a heat pipe is a circular pipe. In the technical proposal of the invention, all the U-shaped central sections of the first heat pipes 51 are pieced together to form the smoothing surface 52. Correspondingly, one side of the U-shaped central section of each first heat pipe 51, matched with the smoothing surface 52, is also subjected to flattening treatment to form a structure, of which one side is flattened, as illustrated in FIG. 9. Moreover, in the preferred embodiment of the invention, in order to be matched with the U-shaped ends of the first heat pipes 51 in shape, a plurality of first grooves 15 are equidistantly formed along the axial direction of the wall of the trumpet-shaped inner cavity 11 of the heat sink 1 and used for receiving and being matched with the U-shaped ends of the first heat pipes 51, so that the U-shaped ends of the first heat pipes 51 can be matched with and tightly adhered to corresponding first grooves 15. Wherein, it shall be noted that the first grooves 15 take the shape of circular arcs and are grooves with radian. One sides of the first heat pipes 51, adhered to the first grooves 15, are cambered surfaces correspondingly and take the original shape of the first heat pipes 51 after fabrication, and thus the sides are not required for reprocessing.

As adhered portions of the U-shaped ends of a plurality of the first heat pipes 51 and the trumpet-shaped inner cavity 11 and the outerwall of the lamp cup 2 cannot completely cover the whole wall of the trumpet-shaped inner cavity 11 or the outerwall of the lamp cup 2, the heat distributed to the heat sink 1 and the lamp cup 2 may be not uniform enough during the heat conduction, and thus the heat dissipation efficiency may be affected. In order to solve the problem, at least one third transverse heat pipe 53 is also arranged inside the first heat conduction component 5. Each third transverse heat pipe 53 is bent and surrounds the periphery of the lamp cup 2 and is adhered to the lamp cup 2. The rear of the third transverse heat pipe 53 makes contact with the wall of the trumpet-shaped inner cavity 11 of the heat sink 1 or inner side faces of the U-shaped ends of the first heat pipes 51 in view of different positions. In order to realize reasonable structure and convenient assembly, a third groove 23 with appropriate dimension can be formed on the outerwall of the lamp cup 2 and used for clamping each third transverse heat pipe 53. In addition, as the same with the first heat pipe 51 as illustrated in FIG. 9, the outer side face of each third transverse heat pipe 53, namely one side of the third transverse heat pipe 53, which makes contact with the U-shaped ends of the first heat pipes 51 and the wall of the trumpet-shaped inner cavity 11 of the heat sink 1, is subjected to flattening treatment, so that the outer side face of each third transverse heat pipe 53 can be adhered to the U-shaped ends of the first heat pipes 51 and the wall of the trumpet-shaped inner cavity 11 of the heat sink 1 as much as possible, and thus the heat dissipation efficiency can be guaranteed. It is notable that in a schematic diagram of a sintered heat pipe as illustrated in FIGS. 8 and 9, a working solution and a composite structure having a capillary and a slot, in the heat pipe are important for the implementation of good heat conduction efficiency of the heat pipe. In the preferred embodiment, the heat produced by the LED module 3 can be quickly transmitted along the U-shaped ends via the smoothing surface 52 of the first heat pipes 51; and as matched with the third transverse heat pipe 53, a great part of the heat is transmitted to the heat sink 1 via the wall of the trumpet-shaped inner cavity 11 and dispersed by the heat dissipation structure 13 of the heat sink 1 and a small part of the heat is transmitted to the lamp cup 2 via the outerwall of the lamp cup 2 and dispersed by the lamp cup 2.

The second heat conduction component 8 is the other heat conduction component of the invention. In order to fix the second heat conduction component 8 and relevant internal components, the cylindrical fastening device 7 is additionally sleeved at the rear of the cylindrical inner cavity of the heat sink 1.

Figure 7:
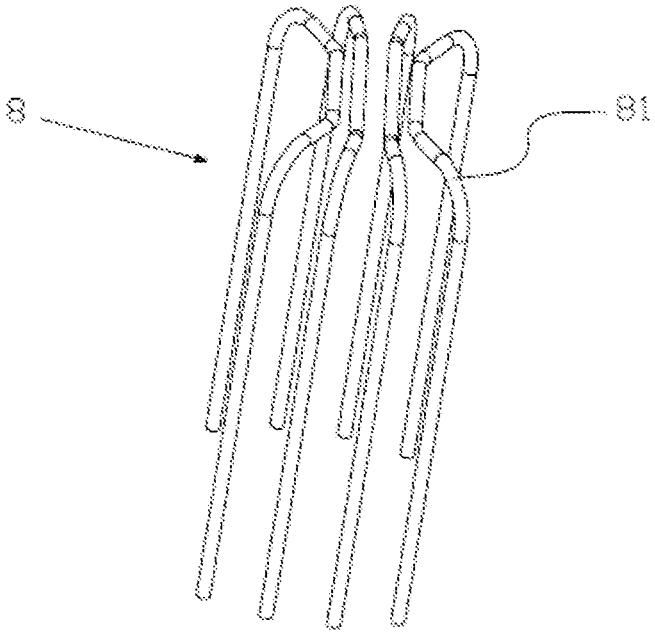
FIG. 7 is a structure diagram of a plurality of second heat pipes of the LED projection lamp provided by the invention.

As illustrated in FIG. 7, in a specific structure, the second heat conduction component 8 mainly comprises a plurality of second heat pipes 81 which are all bent in the shape of a U, so that each second heat pipe 81 has a U-shaped central section and two U-shaped ends. Of course, one U-shaped second heat pipe 81 can be formed by bending a single heat pipe and can also be formed by piecing two L-shaped heat pipes together. The U-shaped central sections of a plurality of the second heat pipes 81 are mutually pieced together and make vertical contact with the U-shaped central sections of the first heat pipes 51 in the up-and-down direction, and thus optimal heat conduction condition can be achieved. The U-shaped ends of a plurality of the second heat pipes 81 are disposed on the same side relative to the U-shaped central sections and encircled to form an annular fencing, so as to be matched with the fastening device 7 and the cylindrical inner cavity 12 of the heat sink 1 in shape. In the mounting and matching structure, the U-shaped ends of a plurality of the second heat pipes 81 are sleeved outside the fastening device 7 and adhered to the wall of the cylindrical inner cavity 12 of the heat sink 1. Therefore, the heat produced by the LED module 3 during the operation can be quickly transmitted to the U-shaped central sections of the second heat pipes 81 via the smoothing surface 52 formed by the first heat pipes 51, and then quickly transmitted to various U-shaped ends of the second heat pipes 81, and finally quickly transmitted to the cylindrical inner cavity 12 of the heat sink and the fastening device 7 via the U-shaped ends and dispersed by the heat sink 1 and the fastening device 7.

Similarly, the second heat pipes 81 are similar to the first heat pipes 51 as illustrated in FIG. 8. The heat pipes are heat conduction elements having slots and sintered capillary structures and achieve the heat transmission effect through the gas-liquid two-phase change of internal working solutions and the capillary force. The basic structure of a heat pipe is a circular pipe. In the technical proposal of the invention, in order to be matched with the U-shaped ends of the second heat pipes 81 in shape, a plurality of second grooves 16 are equidistantly formed along the axial direction of the wall of the cylindrical inner cavity 12 of the heat sink 1 and used for receiving and being matched with the U-shaped ends of the second heat pipes 81, so that the U-shaped ends of the second heat pipes 81 can be matched with and tightly adhered to corresponding second grooves 16. Wherein, it shall be noted that the second grooves 16 take the shape of circular arcs and are grooves with radian. One sides of the second heat pipes 81, adhered to the second grooves 16, are cambered surfaces correspondingly and take the original shape of the second heat pipes 81 after fabrication, and thus the sides are not required for reprocessing.

As adhered portions of the U-shaped ends of a plurality of the second heat pipes 81 and the cylindrical inner cavity 12 and the outerwall of the fastening device 7 cannot completely cover the whole wall of the cylindrical inner cavity 12 or the outerwall of the fastening device 7, the heat distributed to the heat sink 1 and the fastening device 7 may be not uniform enough during the heat conduction, and thus the heat dissipation efficiency may be affected. In order to solve the problem, at least one fourth transverse heat pipe 82 is also arranged inside the second heat conduction component 8. Each fourth transverse heat pipe 82 is bent and surrounds the periphery of the fastening device 7 and is adhered to the fastening device 7. The rear of the fourth transverse heat pipe 82 makes contact with the cylindrical inner cavity 12 of the heat sink 1 or inner side faces of the U-shaped ends of the second heat pipes 81 in view of different positions. In order to realize reasonable structure and convenient assembly, a fourth groove 71 with appropriate dimension can be formed on the outerwall of the fastening device 7 and used for clamping each fourth transverse heat pipe 82. In addition, the outer side face of the fourth transverse heat pipe 82, namely one side of the fourth transverse heat pipe 82, which makes contact with the U-shaped ends of the second heat pipes 81 and the wall of the cylindrical inner cavity 12 of the heat sink 1, is subjected to flattening treatment, so that the outer side face of each fourth transverse heat pipe 82 can be adhered to the U-shaped ends of the second heat pipes 81 and the wall of the cylindrical inner cavity 12 of the heat sink 1 as much as possible, and thus the heat dissipation efficiency can be guaranteed. The structure of the outer side face of the fourth transverse heat pipe 82 after flattening can also refer to FIG. 9. In the preferred embodiment, the heat produced by the LED module 3 can be quickly transmitted to the U-shaped central sections of the second heat pipes 81 via the smoothing surface 52 of the first heat pipes 51 first, and then quickly transmitted along the U-shaped ends of the second heat pipes 81; and as matched with the fourth transverse heat pipe 82, a great part of the heat is transmitted to the heat sink 1 via the wall of the cylindrical inner cavity 12 and dispersed by the heat dissipation structure 13 of the heat sink 1 and a small part of the heat is transmitted to the fastening device 7 via the outerwall of the fastening device 7 and dispersed by the fastening device 7.

Figure 10:
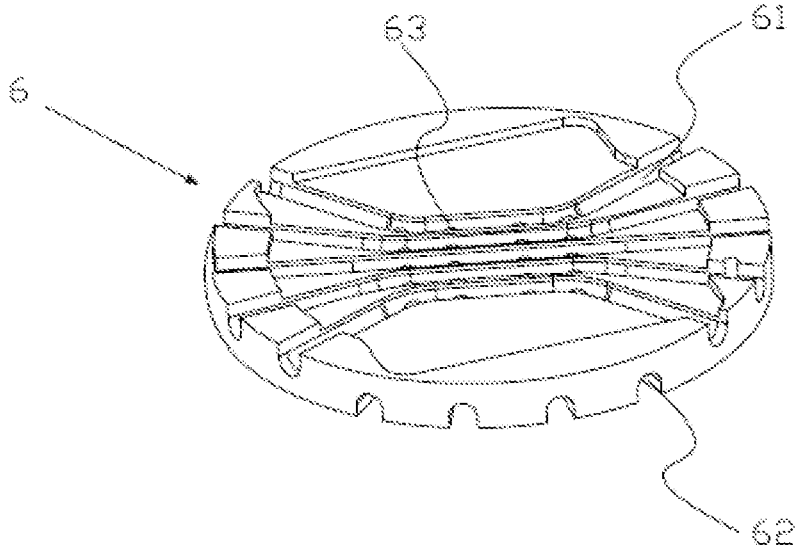
FIG. 10 is a structure diagram of a mounting plate of the LED projection lamp provided by the invention.
Figure 11:
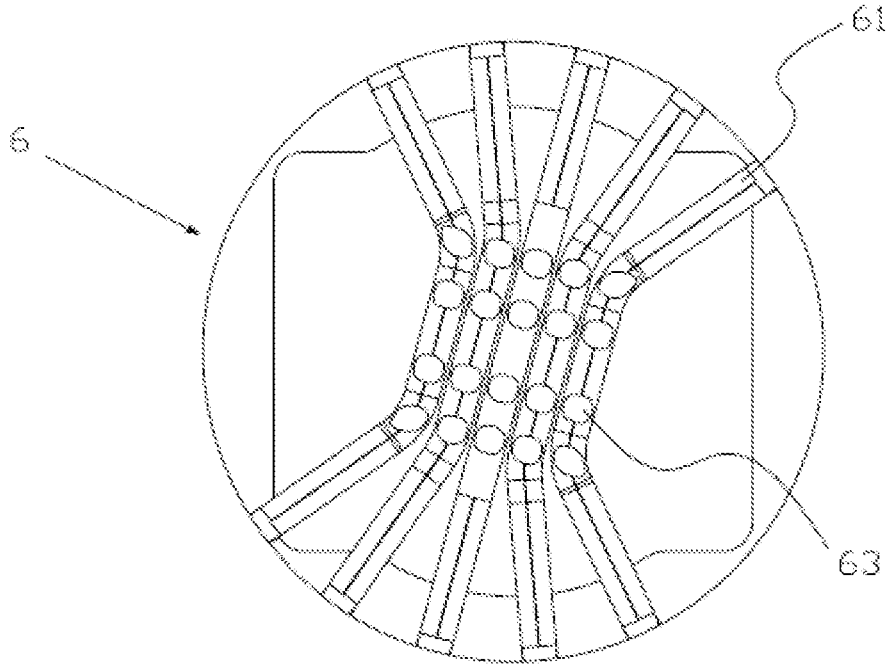
FIG. 11 is a front view of the mounting plate of the LED projection lamp provided by the invention.

In the invention, the first heat pipes 51 are supported and fixed by the mounting plate 6 and disposed at the rear of the smoothing surface 52 of the first heat pipes 51 in the overall structure. As illustrated in FIGS. 10 and 11, in the state, a first clamping thread 61 of which the shape is matched with that of the U-shaped central sections of the first heat pipes 51 can be usually formed on the front of the mounting plate 6 and used for clamping the U-shaped central sections of the first heat pipes 51, so that stable fixing effect can be achieved. In addition, the other function of the mounting plate 6 is to fix the second heat conduction component 8. In the preferred embodiment, a second clamping thread 62 of which the shape is matched with that of the U-shaped central sections of the second heat pipes 81 can be formed at the rear of the mounting plate 6 and used for clamping the U-shaped central sections of the second heat pipes 81, so that stable fixing effect can be achieved. In the preferred proposal, in order to not affect the heat conduction efficiency of the first heat pipes 51 and the second heat pipes 81, the mounting plate 6 can be made of metallic materials. Moreover, a hole 63 can be preferably formed between the first clamping thread 61 and the second clamping thread 62, so that the clamped U-shaped central sections of the first heat pipes 51 can make contact with the clamped U-shaped central sections of the second heat pipes 81.

If the fixing effect cannot be achieved by only adopting the mounting plate 6 for fixing the first heat pipes 51 and the second heat pipes 81, a second mounting plate 9 can also be arranged at the rear of the U-shaped central sections of the second heat pipes 81 of the invention. The second mounting plate 9 is used for supporting and fixing the U-shaped central sections of the second heat pipes 81 and matched with the mounting plate 6 for clamping the second heat pipes 81, and then stable fixing effect can be achieved. Of course, in the preferred proposal, a clamping thread 91 of which the shape is matched with that of the U-shaped central sections of the second heat pipes 81 can be formed on the front of the second mounting plate 9 and used for clamping the U-shaped central sections of the second heat pipes 81. Therefore, ideal fixing effect can be achieved without performing flattening treatment on the U-shaped central sections of the second heat pipes 81.

As seen from the above structure, the heat produced by the LED module 3 can be dispersed via two paths which are respectively the first heat conduction component 5 and the second heat conduction component 8. As both the first heat conduction component 5 and the second heat conduction component 8 adopt superconducting components such as the heat pipes, very high heat conduction efficiency can be realized and the heat can be quickly transmitted to the heat sink 1 having the function of primary heat dissipation and the lamp cup 2 and the fastening device 7 having the function of secondary heat dissipation and then dispersed.

Commonly fixed and mounted lighting fixtures usually have good radiating effect by only adopting a superconducting component such as a vapor chamber and a heat pipe. However, the illumination direction of projection lamps may need to be adjusted at any moment due to the differences in workplaces and functions, so the projection lamps usually do not have fixed illumination angle. As is now well known, the superconducting component such as the vapor chamber and the heat pipe has directionality during the heat conduction. As the reflux of a working solution in the superconducting component may be affected by gravity, the working solution is refluxed downwards to the heat source during the condensing reflux, and the process is obviously faster than the case that the working solution is refluxed upwards due to the gravity action. Therefore, when a heat source is disposed on the lower part and the heat is dispersed upwards, as the working solution is disposed on the lower part due to the gravity action, is close to the heat source and then can absorb the heat of the heat source at shortest distance, the heat conduction is relatively fast and the efficiency is relatively high; and when the heat source is disposed on the upper part and the heat is dispersed downwards, as the working solution is disposed on the lower part due to the gravity action and is far away from the heat source, the heat conduction is relatively slow and the efficiency is relatively low.

Due to the above factors, the LED projection lamp provided by the invention adopts two superconducting components, namely the first heat conduction component 5 and the second heat conduction component 8, to achieve perfect radiating effect. More specifically, the process can be discussed from two extreme directions: (1) when the projection lamp illuminates downwards; and (2) when the projection lamp illuminates upwards.

Figure 12:
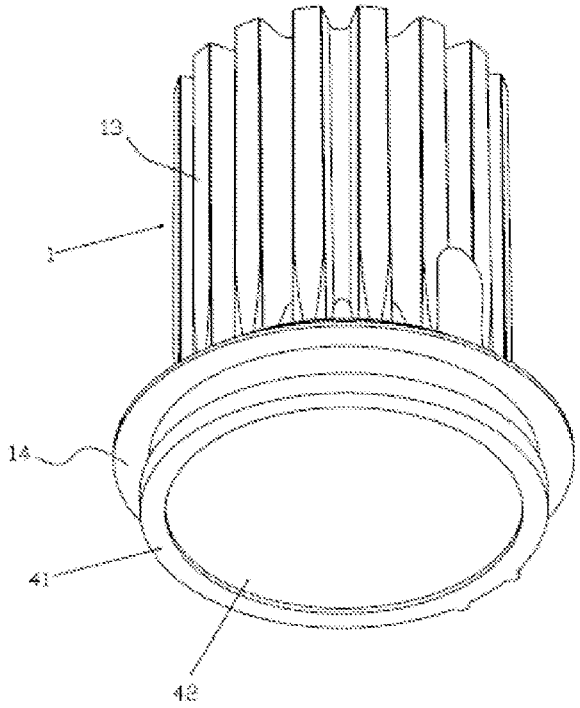
FIG. 12 is a structure diagram of the LED projection lamp provided by the invention when illuminating downwards.
Figure 14:
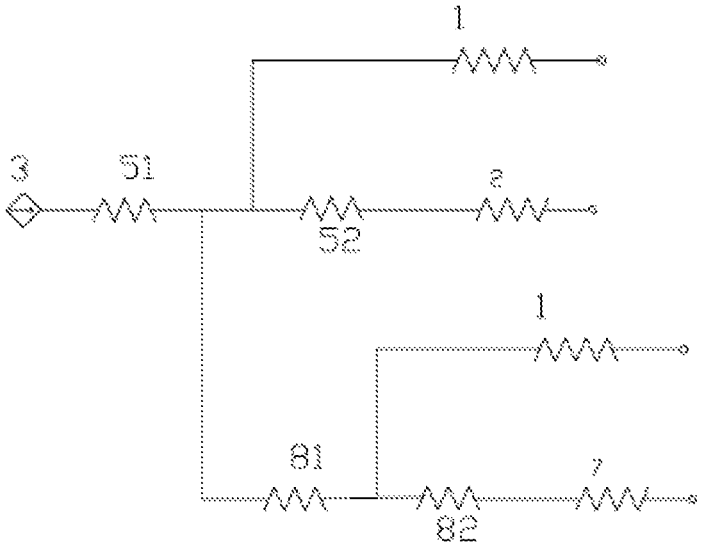
FIG. 14 is a schematic diagram of an equivalent heat dissipation path of the LED projection lamp provided by the invention.

(1) When the Projection Lamp Illuminates Downwards:

As illustrated in FIG. 12, when the projection lamp illuminates at the angle, the LED module 3 as the heat source is disposed on the lower part relative to the first heat conduction component 5 and disposed on the upper part relative to the second heat conduction component 8. That is to say, in the state, the first heat conduction component 5 has higher heat conduction efficiency compared with the second heat conduction component 8. Therefore, the first heat conduction component 5 has the function of primary heat dissipation. As illustrated in FIG. 14, the heat dissipation path of the first heat conduction component 5 is as follows:

The heat is transmitted from the LED module 3 to the first heat pipes 51; one part of the heat in the first heat pipes 51 is directly transmitted to the heat sink 1 and the lamp cup 2 and the other part of the heat in the first heat pipes 51 is transmitted to the third transverse heat pipe 53 first and then transmitted to the heat sink 1 and the lamp cup 2 via the third transverse heat pipe 53.

The second heat conduction component 8 has the function of secondary heat dissipation (for example, the heat conduction efficiency of the second heat conduction component 8 is about 50 percent of that of the first heat conduction component 5). As illustrated in FIG. 14, the heat dissipation path of the second heat conduction component 8 is as follows:

The heat is transmitted from the LED module 3 to the second heat pipes 81; and one part of the heat in the second heat pipes 81 is directly transmitted to the heat sink 1 and the fastening device 7 and the other part of the heat in the second heat pipes 81 is transmitted to the fourth transverse heat pipe 82 first and then transmitted to the heat sink 1 and the fastening device 7 via the fourth transverse heat pipe 82.

Figure 13:
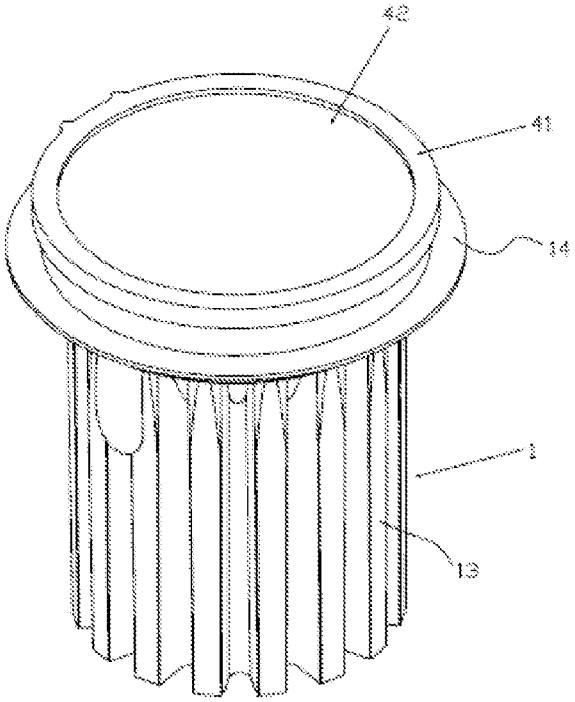
FIG. 13 is a structure diagram of the LED projection lamp provided by the invention when illuminating upwards.

(2) When the Projection Lamp Illuminates Upwards:

As illustrated in FIG. 13, when the projection lamp illuminates at the angle, the LED module 3 as the heat source is disposed on the upper part relative to the first heat conduction component 5 and disposed on the lower part relative to the second heat conduction component 8. That is to say, in the state, the second heat conduction component 8 has higher heat conduction efficiency compared with the first heat conduction component 5. Therefore, the second heat conduction component 8 has the function of primary heat dissipation. As illustrated in FIG. 14, the heat dissipation path of the second heat conduction component 8 is as follows:

The heat is transmitted from the LED module 3 to the second heat pipes 81; and one part of the heat in the second heat pipes 81 is directly transmitted to the heat sink 1 and the fastening device 7 and the other part of the heat in the second heat pipes 81 is transmitted to the fourth transverse heat pipe 82 first and then transmitted to the heat sink 1 and the fastening device 7 via the fourth transverse heat pipe 82.

The first heat conduction component 5 has the function of secondary heat dissipation (for example, the heat conduction efficiency of the first heat conduction component 5 is about 50 percent of that of the second heat conduction component 8).

As illustrated in FIG. 14, the heat dissipation path of the first heat conduction component 5 is as follows:

The heat is transmitted from the LED module 3 to the first heat pipes 51; one part of the heat in the first heat pipes 51 is directly transmitted to the heat sink 1 and the lamp cup 2 and the other part of the heat in the first heat pipes 51 is transmitted to the third transverse heat pipe 53 first and then transmitted to the heat sink 1 and the lamp cup 2 via the third transverse heat pipe 53.

Of course, the above only illustrates the heat dissipation process under extreme situations and more illumination angles may be required during the actual application. However, due to the interaction between the first heat conduction component 5 and the second heat conduction component 8, the above heat dissipation principle will be complied with no matter what the angle is. That is to say, when the LED projection lamp illuminates towards the upper side, the first heat conduction component 5 has the function of primary heat dissipation; and when the LED projection lamp illuminates towards the lower side, the second heat conduction component 8 has the function of primary heat dissipation. Finally, the heat is all transmitted to the heat sink 1, the lamp cup 2 and the fastening device 7 and dispersed by the heat sink 1 playing a leading role via the heat dissipation structure 13 of the heat sink 1. Meanwhile, the lamp cup 2 and the fastening device 7 playing a secondary role also have certain heat dissipating capacity.

It shall be also noted that the total radiating power of the first heat conduction component 5 and the second heat conduction component be more than or equal to the power produced by the LED module 3 in order to guarantee in-time heat dissipation.

As the projection lamp must be multidirectional when used, the power of the first and second heat conduction components must be measured according to the angle applied. Moreover, the total power of the first and second heat conduction components must be more than or equal to the power produced by the LED module.

Of course, the invention is not limited to the above implementations. Those skilled in the art can also make equivalent deformations or replacements on the premise of not departing from the spirit of the invention. The equivalent deformations or replacements shall be all within the scope limited by the claims of the application.

What is claimed is:

1. An LED projection lamp, comprising:

a heat sink, in which the heat sink being cylindrical; a heat dissipation structure arranged on a cylindrical periphery of the heat sink; and a trumpet-shaped inner cavity gradually expanded from inside to the heatsink the front end of a cylindrical inner cavity of the heat sink;

a lamp cup, in which the lamp cup taking the shape of a trumpet matched with the trumpet-shaped inner cavity of the heat sink and having a large opening portion and a small opening portion; the large opening portion clamped on an outer edge formed at the front end of the heat sink; and the small opening portion disposed in the inner cavity of the heat sink;

an LED module, in which the LED module formed by a plurality of LED chips packaged on an aluminum nitride ceramic wafer and disposed on the small opening portion of the lamp cup;

a lens fixed at the front end of the heat sink through a retainer ring wherein the lens is configured to transmit light emitted by the LED module;

a first heat conduction component, comprising a plurality of first heat pipes bent in the shape of a U, in which U-shaped central sections of a plurality of the first heat pipes mutually pieced together to form a smoothing surface for supporting and fixing the LED module; and U-shaped ends of a plurality of the first heat pipes sleeved outside the lamp cup and adhered to the wall of the trumpet-shaped inner cavity of the heat sink;

a fastening device, in which the fastening device being cylindrical and sleeved at the rear end of the cylindrical inner cavity of the heat sink;

a second heat conduction component, comprising a plurality of second heat pipes bent in the shape of a U, in which U-shaped central sections of a plurality of the second heat pipes being mutually pieced together and making contact with the U-shaped central sections of the first heat pipes; and U-shaped ends of a plurality of the second heat pipes sleeved outside the fastening device and adhered to the wall of the cylindrical inner cavity of the heat sink; and a mounting plate, in which the mounting plate disposed at the rear of the smoothing surface of a plurality of the first heat pipes and used for supporting and fixing the U-shaped central sections of the first and second heat pipes;

wherein the total radiating power of the first and second heat conduction components being more than or equal to the power produced by the LED module; and a heat conduction path being as follows: the heat directly conducted from the LED chips to the aluminum nitride ceramic wafer first, then directly conducted to the first and second heat conduction components, finally conducted to the first heat pipes or the second heat pipes, an inner radiator and an outer radiator, and dispersed by fin devices of the inner and outer radiators via cross-ventilation and radiation, in which the aluminum nitride ceramic wafer and the heat pipes being all heat conducting media with low thermal resistance.

2. The LED projection lamp according to claim 1, wherein the first heat conduction component also comprises at least one third transverse heat pipe which is bent and surrounds a periphery of the lamp cup; a third groove for receiving the third transverse heat pipe is formed on an outerwall of the lamp cup having a circular arc shape; one side of the third transverse heat pipe is a cambered surface formed to correspond to the third groove; and an outside of the third transverse heat pipe makes contact with a wall of the trumpet-shaped inner cavity of the heat sink and the insides of the U-shaped ends of the first heat pipes.

3. The LED projection lamp according to claim 1, wherein the second heat conduction component also comprises at least one fourth transverse heat pipe which is bent and surrounds a periphery of the fastening device; a fourth groove for receiving the fourth transverse heat pipe is formed on an outerwall of the fastening device having a circular arc shape; one side of the fourth transverse heat pipe is a cambered surface formed to correspond to the fourth groove; and an outside of the fourth transverse heat pipe makes contact with a wall of the cylindrical inner cavity of the heat sink and the insides of the U-shaped ends of the second heat pipes.

4. The LED projection lamp according to claim 2, wherein the second heat conduction component also comprises at least one fourth transverse heat pipe which is bent and surrounds the periphery of the fastening device; a fourth groove for receiving the fourth transverse heat pipe is formed on the outerwall of the fastening device having a circular arc shape; one side of the fourth transverse heat pipe is a cambered surface formed to correspond to the fourth groove; and the outside of the fourth transverse heat pipe makes contact with a wall of the cylindrical inner cavity of the heat sink and the insides of the U-shaped ends of the second heat pipes.

5. The LED projection lamp according to claim 1, wherein a plurality of first grooves are formed along an axial direction of a wall of the trumpet-shaped inner cavity of the heat sink; the U-shaped ends of the first heat pipes are matched with and tightly adhered to an insides of the first grooves; the first grooves having a circular arc shape; and one sides of the first heat pipes, are cambered surfaces formed to correspond to the first grooves.

6. The LED projection lamp according to claim 1, wherein a plurality of second grooves are formed along an axial direction of a wall of the cylindrical inner cavity of the heat sink; the U-shaped ends of the second heat pipes are matched with and tightly adhered to an insides of the second grooves; the second grooves having a circular arc shape; and one sides of the second heat pipes are cambered surfaces formed to correspond to the second grooves.

7. The LED projection lamp according to claim 5, wherein a plurality of second grooves are formed along an axial direction of a wall of the cylindrical inner cavity of the heat sink; the U-shaped ends of the second heat pipes are matched with and tightly adhered to insides of the second grooves; the second grooves having a circular arc shape; and one sides of the second heat pipes are cambered surfaces formed to correspond to the second grooves.

8. The LED projection lamp according to claim 1, wherein the mounting plate is disposed between the U-shaped central sections of the first heat pipes and the U-shaped central sections of the second heat pipes; a first clamping thread of which a shape is matched with that of the U-shaped central sections of the first heat pipes is formed on a front of the mounting plate and used for clamping the U-shaped central sections of the first heat pipes; a second clamping thread of which a shape is matched with that of the U-shaped central sections of the second heat pipes is formed at a rear of the mounting plate and used for clamping the U-shaped central sections of the second heat pipes; and a hole is formed between the first clamping thread and the second clamping thread, so that the clamped U-shaped central sections of the first heat pipes can make contact with the clamped U-shaped central sections of the second heat pipes.

9. The LED projection lamp according to claim 1, wherein a second mounting plate is also arranged at a rear of the U-shaped central sections of the second heat pipes and used for supporting and fixing the U-shaped central sections of the second heat pipes; and a clamping thread of which a shape is matched with that of the U-shaped central sections of the second heat pipes is formed on a front of the second mounting plate and used for clamping the U-shaped central sections of the second heat pipes.

10. The LED projection lamp according to claim 8, wherein a second mounting plate is also arranged at the rear of the U-shaped central sections of the second heat pipes and used for supporting and fixing the U-shaped central sections of the second heat pipes; and a clamping thread of which a shape is matched with that of the U-shaped central sections of the second heat pipes is formed on a front of the second mounting plate and used for clamping the U-shaped central sections of the second heat pipes.

11. The LED projection lamp according to claim 1, wherein an outward flange is formed on the outer edge at the front end of the heat sink; and the retainer ring is clamped on the outward flange.

12. The LED projection lamp according to claim 1, wherein the lens is a Fresnel lens.

13. The LED projection lamp according to claim 11, wherein the lens is a Fresnel lens.

14. The LED projection lamp according to claim 12, wherein a light-transmitting mirror for covering the lens is clamped on the retainer ring.

15. The LED projection lamp according to claim 13, wherein a light-transmitting mirror for covering the lens is clamped on the retainer ring.

* * * * *